US005921784A

United States Patent [19]

Petersen et al.

[11] Patent Number: 5,921,784

[45] Date of Patent: Jul. 13, 1999

[54] HIGH SPEED CARD EDGE CONNECTOR WITH TUBULAR SHARED GROUND CONTACT

[75] Inventors: Carl C. Petersen, Mentor, Ohio; Ronald P. Sidor, Stratford, Conn.; Robert J. Shiley, II, York, Pa.

[73] Assignee: Framatome Connectors USA Inc., Fairfield, Conn.

[21] Appl. No.: 08/853,338

[22] Filed: May 8, 1997

[51] Int. Cl.[6] ..... H01R 9/09

[52] U.S. Cl. ..... 439/60; 439/608

[58] Field of Search ..... 439/608, 60, 108, 439/101, 637

[56] References Cited

U.S. PATENT DOCUMENTS

| | | | |
|---|---|---|---|
| 3,399,372 | 8/1968 | Uberbacher | 439/60 |
| 3,727,175 | 4/1973 | Grenda | 439/857 |
| 4,846,734 | 7/1989 | Lytle | 439/637 |
| 4,891,023 | 1/1990 | Lopata | 439/637 |
| 4,894,002 | 1/1990 | Guckenheimer | 439/260 |
| 5,026,292 | 6/1991 | Pickles et al. | 439/108 |
| 5,425,658 | 6/1995 | White | 439/637 |

*Primary Examiner*—Steven L. Stephan
*Assistant Examiner*—Jean F. Duverne
*Attorney, Agent, or Firm*—Perman & Green, LLP

[57] ABSTRACT

A card edge connector comprising a housing, signal contacts and a ground contact. The housing has a card edge receiving area. The signal contacts are connected to the housing. The ground contact is connected to the housing and generally surrounds a corresponding signal contact.

20 Claims, 3 Drawing Sheets

HIGH SPEED CARD EDGE CONNECTOR WITH TUBULAR SHARED GROUND CONTACT

BACKGROUND OF THE INVENTION

1. Field of the Invention

The present invention relates to card edge connectors and, more specifically, to a high speed card edge connector with a tubular shaped ground contact.

2. Prior Art

Card edge connectors are well known in the art. Examples may be found in U.S. Pat. Nos. 4,894,022; 4,846,734; 5,026,292 and 5,425,658. The ever present need to minimize the size of card edge connectors, to allow more connectors to be placed on mother printed circuit boards and to allow more contacts to be housed in a single connector, has resulted in a corresponding reduction in the pitch of the signal contacts. This has rendered the signal contacts susceptible to electro-magnetic interference from adjoining signal contacts affecting high speed signal transmissions.

SUMMARY OF THE INVENTION

In accordance with one embodiment of the present invention, a card edge connector is provided comprising a housing, signal contacts and a ground contact. The housing has a card edge receiving area. The signal contacts and the ground contact are connected to the housing. The ground contact generally surrounds a corresponding signal contact.

In accordance with another embodiment of the present invention a card edge connector is provided comprising a housing, signal contacts and a ground contact. The housing has a card edge receiving area. The signal contacts and the ground contact are connected to the housing. The ground contact has two pairs of opposing contact surfaces, wherein one of the contact surfaces of each pair of contact surfaces is located on opposite sides of the card edge receiving area.

In accordance with yet another embodiment of the present invention, a card edge connector is provided comprising a housing, signal contacts and ground contacts. The housing has a card edge receiving area. The signal contacts and the ground contacts are connected to the housing. Each ground contact is a one-piece member having an upper body and a lower body. The upper body is generally tubular with two opposing elongated channel sections on opposite sides of the card edge receiving area. Each elongated channel section has two longitudinal edges facing the card edge receiving area. Contact surfaces project from the longitudinal edges to contact corresponding ground pads on opposing sides of a daughter board, when the daughter board is inserted into the card edge receiving area.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
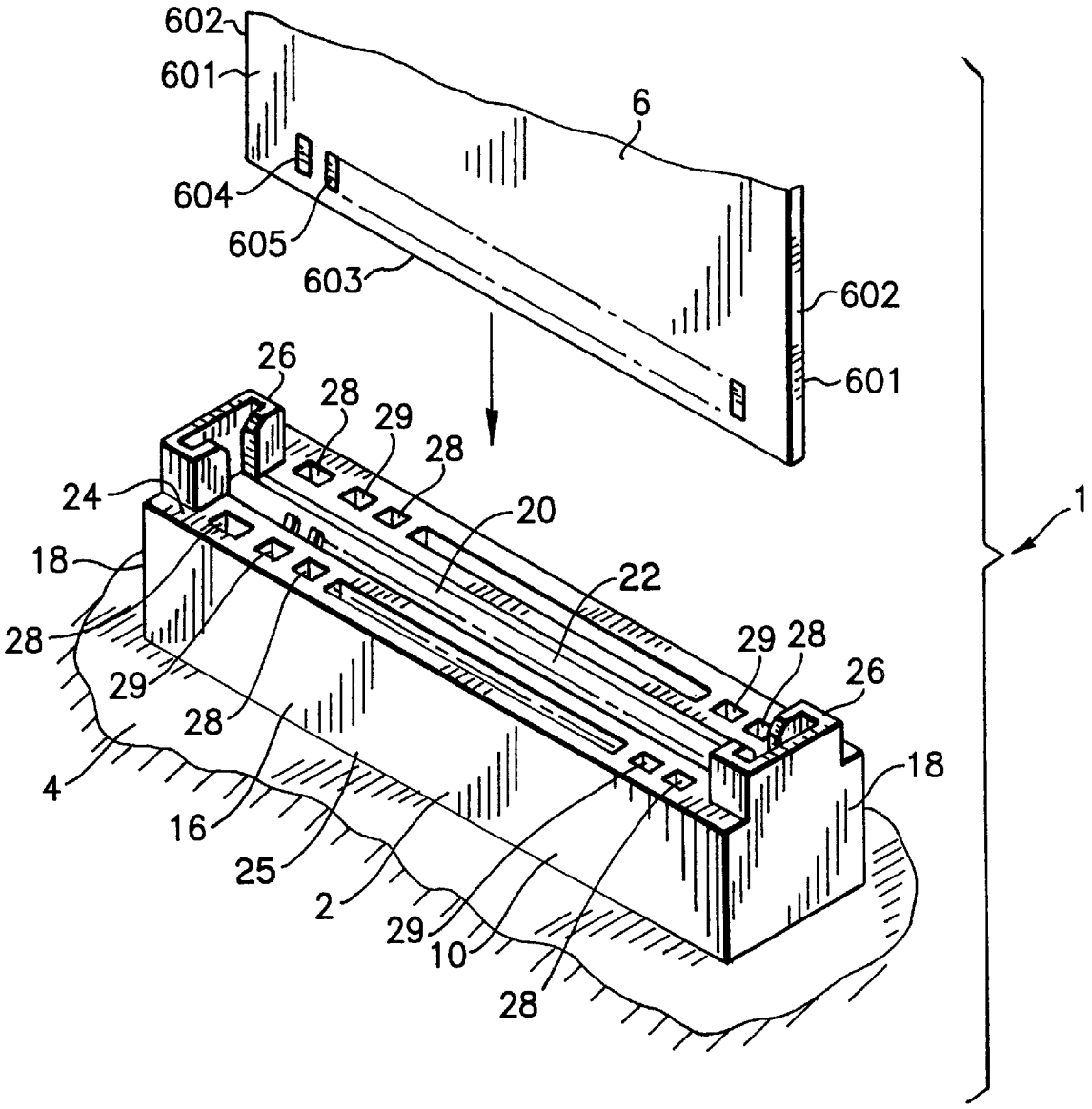
FIG. 1 is an exploded partial perspective view of a printed circuit board assembly incorporating features of the present invention.

Referring to FIG. 1, there is shown an exploded partial perspective view of a printed circuit board assembly 1 incorporating features of the present invention. Although the present invention will be described with reference to the single embodiment shown in the drawings, it should be understood that the present invention can be embodied in various different types of printed circuit board assemblies. In addition, any suitable size, shape or type of elements or materials could be used.

The printed circuit board assembly 1 shown in FIG. 1 comprises a high speed card edge connector 2 connecting a daughter printed circuit board 6 to a mother printed circuit board 4. The card edge connector 2 is fixedly connected to the mother board 4. The daughter board 6 is removably connected to the card edge connector 2. Thus, the daughter board is connected by the connector 2 to the mother board 4.

Figure 2:
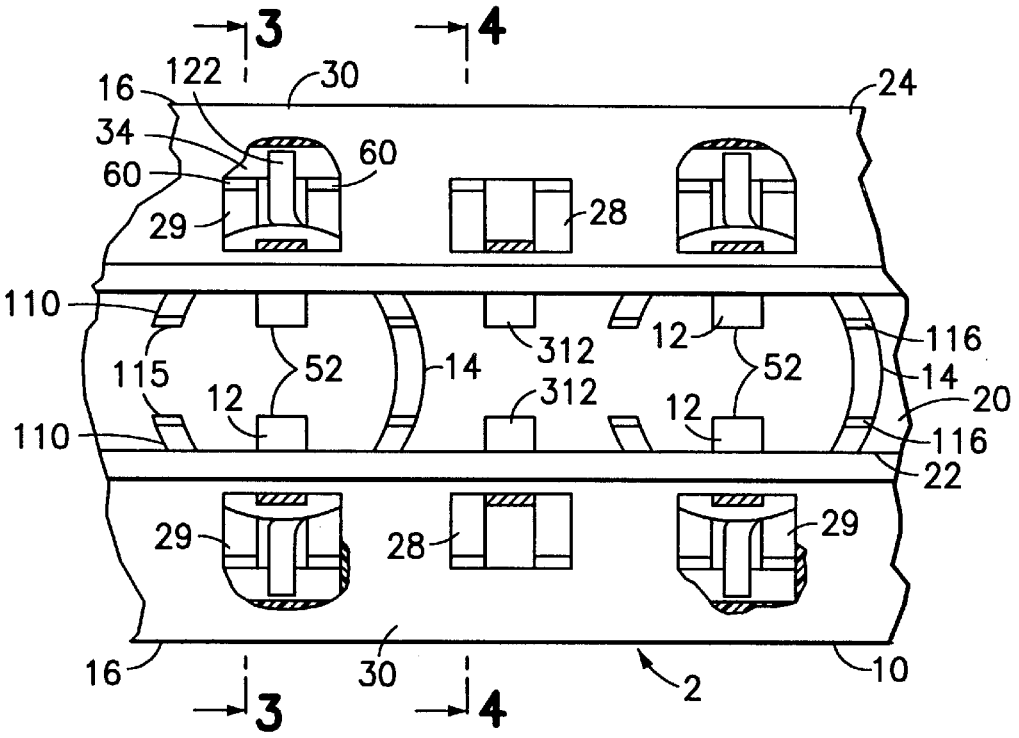
FIG. 2 is a partial, top plan view of the high speed card edge connector included in the printed circuit board assembly shown in FIG. 1 with cut-away areas at some of the signal contacts.

Referring also to FIG. 2 the high speed card edge connector 2 comprises a housing 10, signal contacts 12, 312 and ground contacts 14. The housing 10 is made from a dielectric material such as molded plastic. The housing 10 has outer walls 16 extending between ends 18. A card edge receiving area 20 extends into the housing 10. The card edge receiving area 20 has an opening 22 in the top 24 of the housing 10. In the preferred embodiment, daughter board supports 26, shown in FIG. 1, extend upward from the top 24 of the housing 10 at each end 18. The supports 26 have a general channel shape generally aligned with the card edge receiving area 20, which provides the daughter board 6 with lateral support when inserted into the card edge receiving area 20. In alternate embodiments, the daughter board supports may be located at other points along the top of the housing or the daughter board may be laterally supported, when inserted into the card edge receiving area, only by internal structure of the housing.

Figure 3:
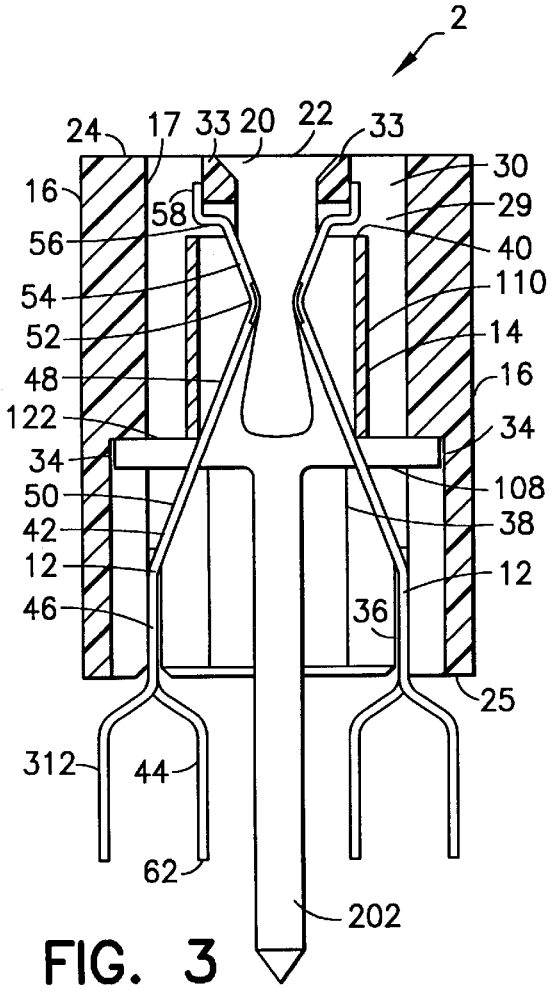
FIG. 3 is a cross sectional view of the high speed card edge connector shown in FIG. 2, taken along line 3—3.
Figure 4:
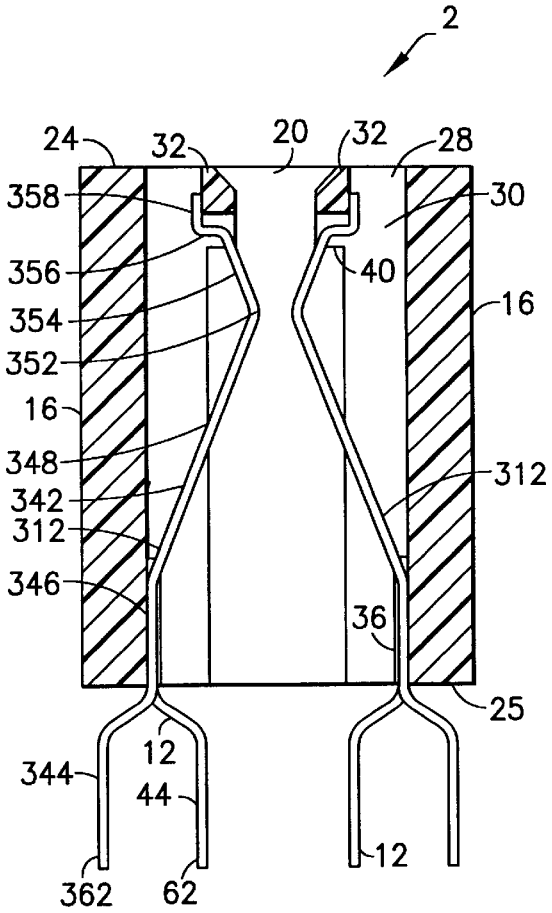
FIG. 4 is a cross-sectional view of the high speed card edge connector shown in FIG. 2, taken along line 4—4.

The housing comprises signal contact receiving channels 28,29. Signal contact receiving channels 28 are alternatingly located with signal contact receiving channels 29 in two rows on each side of the card edge receiving area 20. Signal contact receiving channels 28 are located first and last in each row. Thus, each channel 29 is located between corresponding channels 28. Channels 29 are separated from adjoining channels 28 by a center to center distance of about 1 mm. In an alternate embodiment, the pitch could be any suitable size, such as 0.05 inch. Referring specifically to FIG. 4, channels 28 extend from the top 24 to the bottom 25 of the housing 10 and are formed by internal partitions 30 extending from the walls 16 inward on each side of the card edge receiving area 20. Preload section 32 spans between corresponding partitions 30 at the top of each channel 28. Otherwise, the channels 28 are open at the top 24 and bottom 25 of the housing 10 and communicate with the card edge receiving area 20. Referring now to FIG. 3, signal contact receiving channels 29 are defined by partitions 30.

Channels 29 extend from the top 24 to the bottom 25 of the housing 10. Preload sections 33 span between corresponding partitions 30 at the top of each channel 29. Channels 29 are open at the top 24 and bottom 25 of the housing 10 and communicate with the card edge receiving area 20. The inner surface 17 of each wall 16 has a horizontal groove 34 extending between corresponding partitions 30 in each channel 29. Vertical slots 36 extend partially into each partition 30 from the bottom 25 of the housing 10. The partial vertical slots 36 are located adjacent the inner surface 17 of the walls 16 and communicate with the respective channels 28 and channels 29 separated by each partition 30. The interior edge 38 of each internal partition 30 has a stepped stop surface 40 proximate the preload sections 33.

Referring specifically to FIG. 3, signal contacts 12 are one-piece members cut and formed from sheet metal. Each signal contact 12 has an upper section 42 and a lower section 44. The upper section 42 comprises a lower seating surface 46 and a spring arm 48 cantilevered therefrom. The spring arm 48 includes a lower span 50, a contact area 52, a cam surface 54, an upper horizontal offset 56 and an upper seating surface 58. The spring arm 48 terminates in the upper seating surface 58. The upper seating surface 58 is offset inward and generally parallel with the lower seating surface 46. The lower span 50, of the spring arm 48, inclines upward and inward, spanning between the lower seating surface 46 and the contact area 52. The contact area 52 is coined to provide increased contact pressure. The cam surface 54 inclines upward and outward from the contact area 52 to the upper horizontal offset 56. The upper offset 56 connects the upper seating surface 58 to the cam surface 54. The lower section 44 comprises a solder tail 62 cantilevered from the lower seating surface 46. Signal contacts 312 are substantially similar to signal contacts 12. Referring also to FIG. 4, each signal contact 312 has an upper section 342 and a lower section 344. The upper section 342 comprises a lower seating surface 346 with a cantilevered spring arm 348 inclined upward and inward terminating in an upper seating surface 358. The spring arm 348 has a coined contact area 352 and a cam surface 354 angled upward and outward to an upper horizontal offset 356 connected to the upper seating surface 358. The lower section 344 of each signal contact 312 comprises a solder tail 362 cantilevered downward from the lower seating surface 346.

Figure 5:
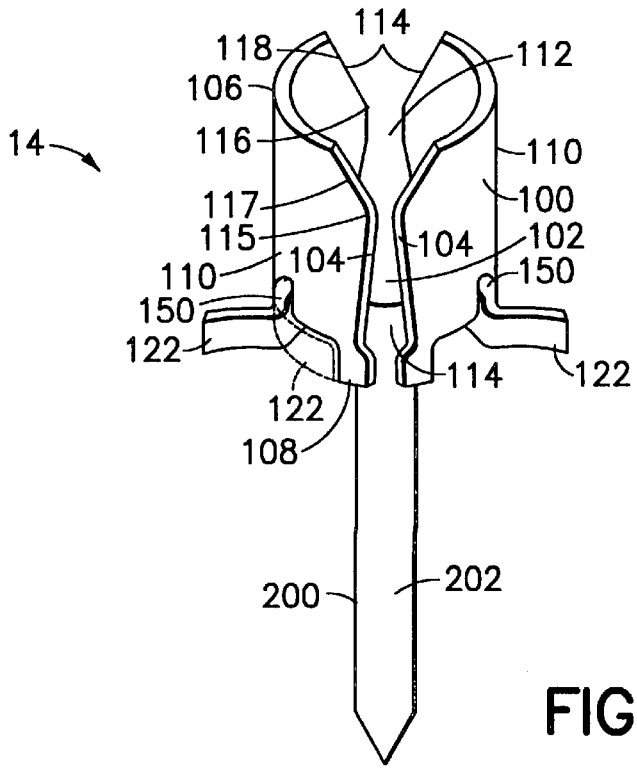
FIG. 5 is a perspective view of a tubular ground contact included in the high speed card edge connector shown in FIG. 2.

Referring specifically to FIG. 5, ground contacts 14 are one piece members cut and formed from sheet metal. Each ground contact 14 has an upper body 100 and a lower body 200. The upper body 100 has a generally tubular shape formed by rolling the sheet metal. In the preferred embodiment, the cross-section of the tubular upper body 100 is generally circular. In alternate embodiments, the cross section of the upper body may be rectangular or any other suitable shape. The tubular upper body 100 has an open cross-section, the gap 102 between longitudinal edges 104, extending from the top 106 to the bottom 108 of the upper body 100. The upper body 100 includes two opposing elongated channel like sections 110. The elongated channel like sections 110 are formed by cutting a partial slot 112, from the top 106 into the upper body 100, diametrically opposite the gap 102. A lower rim 114 connects the opposing elongated channel-like sections 110. Each elongated channel like section 110 has two inward facing longitudinal edges 114, 104. Each longitudinal edge 114, 104 has an inwardly projecting contact surface 116, 115. The contact surfaces 116 on the respective longitudinal edges 114 form one pair of opposing contact surfaces 116. The contact surfaces 115 on the respective longitudinal edges 104 form a second pair. The contact surfaces 116 on longitudinal edges 114 are longitudinally aligned with the contact surfaces 115 on the other longitudinal edges 104 of each elongated channel 110. The contact surfaces 116, 115 on the respective longitudinal edges 114, 104 of each channel 110 are separated by a center to center distance of about 0.05 inch. Each longitudinal edge 104, 114 has a cam surface 117, 118 extending upward and outward from the contact surface 115, 116 to the top 106 of the ground contact 14. In the preferred embodiment, the section 119, 120 below the contact surface 115, 116 on each longitudinal edge 104, 114 angles downward and outward to the lower rim 114. The resulting taper of the longitudinal edges 104, 114 reduces the cross-section of each elongated channel 110 increasing its flexibility. In alternate embodiments, the sections of the longitudinal edges 104, 114, below the contact surfaces 115, 116 may be substantially vertical. Each elongated channel 110 has a tab 122 at the bottom 108. The tab 122 is outwardly deflected and has a width adapted to be admitted in the horizontal grooves 34 of the card edge connector 4 shown in FIG. 3. FIG. 5 shows one of the tabs 122 in dotted lines before it is outwardly deflected. The lower body 200 of each ground contact 14 comprises a solder tail 202 cantilevered downwards from the lower rim 114 of the upper body 100.

Referring to FIGS. 2 and 3, the ground contacts 14 are inserted into the housing 10 of the card edge connector 2 before the signal contacts 12 are inserted. The ground contacts 14 are inserted into the housing 10 from the bottom 25. Each ground contact 14 is located between two corresponding opposing channels 29 of the housing 10. The elongated channels 110 of each ground contact 14 contact the interior edges 38 of adjacent internal partitions 30, laterally stabilizing each ground contact 14 with respect to the housing 10. Each ground contact 14 is oriented so that one of the elongated channels 110 is located on each side of the card edge receiving area 20. One of the longitudinal edges 104, 114 from each pair of longitudinal edges 104, 114 of each ground contact 14 is located on each side of the card edge receiving area 20. The contact surfaces 115, 116 of the ground contacts 14 project into the card edge receiving area 20. The top 106 of each ground contact 14 abuts the stepped stop surface 40 on the corresponding internal partitions 30 preventing further insertion. The circumferential tabs 122 of each ground contact 14 are received into the mating horizontal grooves 34 within the corresponding channels 29 of the housing 10. Locking the tabs 122 into the horizontal grooves 34 fixedly connects the ground contacts 14 to the housing 10. The solder tails 202 of the ground contacts 14 project from the bottom 25 of the housing 10 along its center and are through hole mounted, (not shown), to the mother board 4.

Signal contacts 12 are inserted into corresponding signal contact receiving channels 29 of the housing 10 after the ground contacts 14 are inserted. The signal contacts 12 are inserted into the housing 10 from the bottom 25. The lower seating surface 46 of each signal contact 12 is seated against the inner surface 17 of the outer walls 16. The detents 60 (see FIG. 2) projecting from the lower seating surface 46 are admitted into the partial slots 36 of the internal partitions 30, fixedly connecting each signal contact 12 to the housing 10. The spring arm 48 of each signal contact 12 is inserted through a corresponding ground contact 14 The spring arm 48 of one signal contact 12 on each side of the card edge receiving area 20 extends inside one elongated channel 110 of a corresponding ground contact 14. The cam surface 54 and contact area 52 of each signal contact 12 are located within the surrounding ground contact 14. The contact area 52 projects into the card edge receiving area 20 between the contact surfaces 115, 116 of the corresponding elongated channel 110 of the surrounding ground contact 14. The contact area 52 of each signal contact 12 is separated from the adjacent contact surfaces 115, 116 of ground contacts 14 by a center to center distance of about 0.025 inch. A sufficient gap exists between the bottom 108 of each elongated channel 110 and the lower span 50 of the spring arm 48 within to ensure that the ground contact 14 does not short the signal contact 12 when the spring arm 48 is deflected outward. In the preferred embodiment, the spring arm 48 is sufficiently inclined and the corresponding elongated channel 110 has a scallop 150 (see FIG. 5) to provide the requisite clearance. In alternate embodiments, the gap between the ground contact and spring arm may be provided by any suitable means including having a knee section in the spring arm around the bottom of the ground contact or reducing the length of the ground contact. The cam surface 54 on the spring arm 48 of each signal contact 12 projects above the top 106 of the corresponding elongated channel 110. The upper seating surface 58 contacts the corresponding preload section 33. The cam surface 54 and adjoining horizontal offset 56 are sufficiently separated from the top 106 of the corresponding elongated channel 110 to prevent contact when the spring arm 48 is deflected outward. The solder tail 44 of each signal contact 12 projects from the bottom 25 of the housing 10. Each solder tail 44 is through hole mounted (not shown) to the mother board 4.

Referring now to FIG. 4, signal contacts 312 are inserted into corresponding signal receiving channels 28 of the housing 10. The installation of signal contacts 312 into the housing 10 is substantially similar to the installation of signal contacts 12. The lower seating surfaces 346 contact the outer walls 16. The upper seating surfaces 358 contact the preload sections 32 preloading the spring arms 348. The contact areas 352 and the cam surfaces 354 of the signal contacts 312 project into the card edge receiving area 20. The solder tails 344 of the signal contacts 312 project from the bottom 25 of the housing 10. Each solder tail 344 is through-hole mounted (not shown) to the mother board 4. The contact area 352 of each signal contact 312 is separated from the adjacent contact surfaces 115, 116 of the corresponding ground contacts 14 by a center to center distance of about 0.025 inch.

Referring now to FIG. 1, the daughter printed circuit board 6 has two sides 601 with lateral edges 602. Each side 601 has contact pads 604 and ground pads 605 alternatingly arranged in a row proximate the bottom edge 603 of the daughter board 6. In an alternate embodiment, each side of the daughter board could have two or more rows of contact pads with the signal and ground contacts in the card edge connector being arranged to contact the multiple rows of contact pads. The daughter board 6 is inserted, with the bottom edge 603 first, into the card edge receiving area 20 of the high speed card edge connector 2. The lateral edges 602 of the daughter board 6 are admitted into the daughter board supports 26. The daughter board 6 is inserted between the opposing pairs of signal contacts 12, 312 and opposing elongated channels 110 of ground contacts 14. The sides 601 cooperate with the cam surfaces 54, 354 outwardly deflecting the spring arms 42, 342 of the signal contacts 12, 312. The sides 601 of the daughter board 6 also cooperate with cam surfaces 117, 118 outwardly deflecting the elongated channels 110 of the ground contacts 14. The daughter board 6 continues to be inserted until the contact areas 52, 352 of the signal contacts 12, 312 contact the corresponding contact pads 604 and contact surfaces 115, 116 on the ground contacts 14 contact the corresponding ground pads 605 on the daughter board 6.

The present invention provides a high speed card edge connector 2 with tubular ground contacts 14, wherein the ratio of signal contacts 12, 312 to contact surfaces 115, 116 of ground contacts 14 is about 1 to 1. Adjacent ground contacts 12, 312 which contact each side 601 of the daughter board 6 inserted into the high speed card edge connector 2 have a contact area 115, 116 of a ground contact 14 therebetween grounding the board 6. The ground contacts 14 which surround the contact areas 52 of signal contacts 12 shield contact areas 52, 352 of each signal contact 12, 312 from adjacent signal contacts 12, 312. The synergistic effect provided by having a ground and shielding between adjacent signal contacts 12, 312 may reduce electro-magnetic effects between adjacent signal contacts 12, 312, sufficiently to facilitate a higher rate of signal transmission in comparison to other card edge connectors known in the art with reduced effects from cross-talk or signal distortion. In alternate embodiments, the ratio between signal contacts and contact surfaces of ground contacts may vary. In other alternate embodiments, the signal contacts and contact surfaces of ground contacts may contact only one side of the daughter board inserted in the connector.

It should be understood that the foregoing description is only illustrative of the invention. Various alternatives and modifications can be devised by those skilled in the art without departing from the scope of the present invention. Accordingly, the present invention is intended to embrace all such alternatives, modifications and variances which fall within the scope of the appended claims.

What is claimed is:

1. A card edge connector comprising:

a housing having a card edge receiving area;

signal contacts connected to the housing; and a ground contact connected to the housing, the ground contact including a singular section, wherein the singular section of the ground contact generally surrounds a corresponding signal contact, and wherein the singular section comprises a generally tubular upper body.

2. A card edge connector as in claim 1, wherein the ground contact has two pairs of opposing contact surfaces on opposite sides of the card edge receiving area, the contact surfaces contacting corresponding ground pads on a daughter board inserted in the card edge receiving area between the opposing contact surfaces.

3. A card edge connector as in claim 2, wherein the ground contact is a one piece member made from sheet metal.

4. A card edge connector as in claim 3, wherein the tubular upper body has an open cross section, the tubular upper body having longitudinal edges separated by a gap extending between an upper end and a lower end or the upper body, and wherein the upper body includes the singular section.

5. A card edge connector as in claim 4, wherein the tubular upper body has a partial longitudinal slot extending thereinto from the upper end and located to form two opposing elongated channel like sections on opposite sides of the card edge receiving area with longitudinal edges of the channels facing the card edge receiving area.

6. A card edge connector as in claim 5, wherein one of the contact surfaces of each pair of contact surfaces is located on one of the longitudinal edges of the elongated channel sections on both sides of the card edge receiving area, each pair of contact surfaces projecting into the card edge receiving area from the respective longitudinal edges.

7. A card edge connector as in claim 6, wherein the contact surfaces on the longitudinal edges of each elongated channel section are separated by a center to center distance of about 1 mm.

8. A card edge connector as in claim 6, wherein each longitudinal edge comprises a cam surface extending between the upper end and the respective contact surface, opposing cam surfaces guiding the daughter board between the opposing contact surfaces when the daughter board is inserted into the card edge receiving area.

9. A card edge connector as in claim 6, wherein a portion of the corresponding signal contact extends between the contact surfaces of one of the elongated channel sections.

10. A card edge connector as in claim 4, wherein each ground contact has a lower section extending from the upper body, the lower section comprising a solder tail for connecting the ground contact to a mother board.

11. A card edge connector as in claim 4, wherein the upper body has retention tabs circumferentially cut therein, the tabs being bent outwards to engage complementing surfaces on the housing fixedly connecting the ground contact to the housing.

12. A card edge connector, comprising:

a housing having a card edge receiving area;

signal contacts connected to the housing; and a ground contact connected to the housing, the ground contact having a generally tubular upper body, wherein the upper body has two pairs of opposing contact surfaces, one of the contact surfaces of each pair of contact surfaces being located on opposite sides of the card edge receiving area.

13. A card edge connector as in claim 12, wherein the ground contact is a one-piece member cut and formed from sheet metal.

14. A card edge connector as in claim 13, wherein the ground contact has a lower body, and wherein the generally tubular upper body comprises two opposing elongated channel sections on opposite sides of the card edge receiving area.

15. A card edge connector as in claim 14, wherein each contact surface projects from a respective inward facing longitudinal edge of the elongated channel sections, the two contact surfaces on the corresponding longitudinal edges of each channel being separated by a center to center distance of about 1 mm.

16. A card edge connector as in claim 14, wherein the tubular upper body generally surrounds a portion of one of the signal contacts.

17. A card edge connector as in claim 14, wherein the lower body comprises a solder tail for connecting the ground contact to a mother board, the solder tail being cantilevered from a lower rim of the upper body.

18. A card edge connector as in claim 12 further comprising a plurality of the ground contacts so that the ratio of the contact surfaces to signal contacts is about 1 to 1.

19. A card edge connector, comprising:

a housing with a card edge receiving area;

signal contacts connected to the housing; and ground contacts connected to the housing, each ground contact comprising a one-piece member having an upper body and a lower body, the upper body being generally tubular with two opposing elongated channel sections on opposite sides of the card edge receiving area, wherein each elongated channel section has two longitudinal edges facing the card edge receiving area with contact surfaces projecting therefrom so that the contact surfaces contact corresponding ground pads on opposing sides of a daughter board when the daughter board is inserted into the card edge receiving area.

20. A card edge connector as in claim 19, wherein the lower body is a solder tail for connecting the corresponding ones of the ground contacts to a mother board.

* * * * *